United States Patent [19]

Snavely

[11] Patent Number: 4,579,104

[45] Date of Patent: Apr. 1, 1986

[54] DEVICE FOR MINIMIZING HOT WATER HEAT LOSS IN A WATER HEATER

[75] Inventor: Robert L. Snavely, Lafayette, Ind.

[73] Assignee: A. O. Smith Corporation, Milwaukee, Wis.

[21] Appl. No.: 685,538

[22] Filed: Dec. 24, 1984

[51] Int. Cl.[4] ..... F24H 1/00

[52] U.S. Cl. ..... 126/362; 122/13 R; 137/845

[58] Field of Search ..... 122/13 R; 126/362; 137/845, 512, 496

[56] References Cited

U.S. PATENT DOCUMENTS

| | | | |
|---|---|---|---|
| 1,991,557 | 2/1935 | Johnson | 122/14 |
| 3,200,571 | 8/1965 | Shufflebotham | 137/845 |
| 3,701,560 | 10/1972 | Emmerson | 137/845 |
| 3,750,710 | 8/1973 | Hayner | 138/40 |
| 4,286,573 | 9/1981 | Nickel | 126/362 |

*Primary Examiner*—Edward G. Favors

*Attorney, Agent, or Firm*—Andrus, Sceales, Starke & Sawall

[57] ABSTRACT

A device for minimizing hot water heat loss in a water heater through service fittings during standby periods. The inlet and/or outlet service fittings are provided with an internal sleeve having at least one flap that is integrally hinged to the sleeve. In a no-flow standby condition, the flap extends transversely across the sleeve to close off the fitting and prevent hot water heat loss by convection. During periods of water flow, the flap is pivoted to an open condition to permit water flow through the fitting with minimum restriction.

3 Claims, 3 Drawing Figures

DEVICE FOR MINIMIZING HOT WATER HEAT LOSS IN A WATER HEATER

BACKGROUND OF THE INVENTION

In a conventional storage type water heater, heated water is stored in a tank. On demand, hot water is withdrawn through an outlet in the upper end of the tank and cold water is simultaneously introduced into the lower end of the tank. During standby periods, when there is no water flow, there can be a loss of heated water through the inlet or outlet fittings due to convection. With rising energy costs, the standby heat loss through the service fittings can be a substantial economic factor.

SUMMARY OF THE INVENTION

The invention is directed to a device for minimizing hot water heat loss in a water heater through the service fittings during standby periods. In accordance with the invention, a nipple is connected to the service fitting and a plastic sleeve is secured to the inner surface of the nipple. A plurality of flaps are integrally hinged to the sleeve and in a no-flow standby condition, the flaps extend transversely across the nipple to close off the nipple and prevent hot water heat loss through the nipple by convection.

When heated water is drawn from the water heater, the water flow will cause the flaps to flex to an open condition. When open, the flaps provide minimum restriction to water flow. When the water flow has ceased, the hinged flaps have a memory and will return to their original transverse position to close off the fitting and minimize heat loss by convection.

The invention provides a low cost damper for the service fittings which will act to substantially reduce heat loss through the service fitting by convection during standby periods. When in the open position, the flaps provide minimum restriction to water flow.

As the unit is a one-piece molded plastic structure, there is no noise associated with operation of the unit and the device is unaffected by changes in water pressure.

The damping device of the invention can be used with either the inlet or outlet service fittings, or with both fittings, to minimize loss of heated water.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
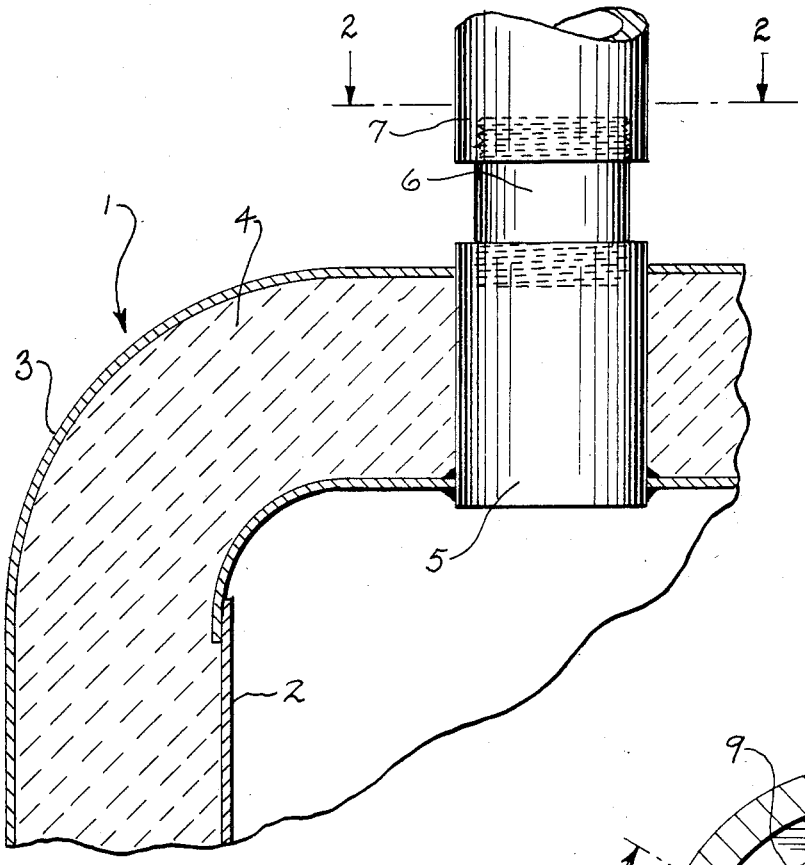
FIG. 1 is a longitudinal section of a portion of a water heater showing the damper device of the invention associated with the outlet of the water heater.

FIG. 1 illustrates a portion of a conventional storage-type water heater 1 having a tank 2 to store heated water. A jacket 3 is spaced outwardly from tank 2 and a layer of insulating material 4 is located between the tank 2 and jacket 3.

Heated water is adapted to be withdrawn from tank 2 through an outlet fitting 5 in the upper end of the tank. A nipple 6 interconnects the outlet fitting 5 with a hot water pipe 7.

In accordance with the invention, a damper device 8 is associated with nipple 6 and serves to minimize hot water heat loss during standby periods through the outlet fitting. Damper device 8 includes a cylindrical sleeve 9 which is secured to the inner surface of nipple 6, and a plurality of flaps 10 are integrally connected to sleeve 9 by hinges 11 and, when in the closed position, extend transversely across the nipple 6. While FIG. 2 shows three flaps 10 being utilized, it is contemplated that one or more flaps can be employed.

The damper device 8, including the sleeve 9, flaps 10, and hinges 11, is preferably formed as a one-piece molded plastic unit.

Figure 2:
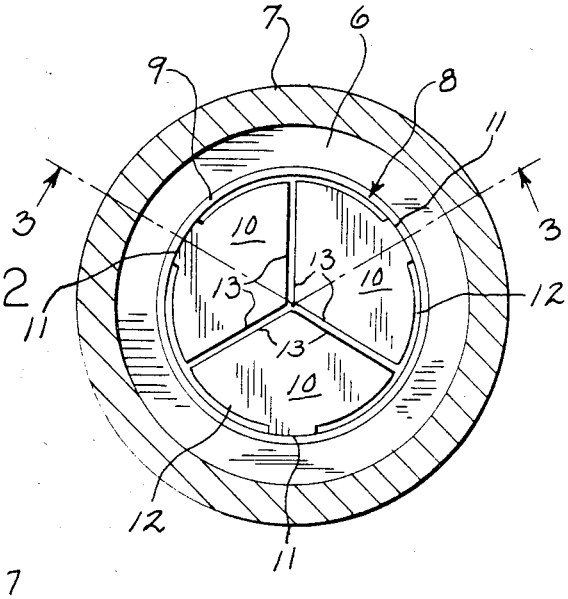
FIG. 2 is a section taken along line 3—3 of FIG. 1.

As shown in FIG. 2, each flap 10 includes a generally curved or arcuate outer edge 12 which complements the inner surface of sleeve 9, and each flap is also provided with a pair of generally straight outer edges 13 which are disposed in proximate relation to corresponding side edges of adjacent flaps, when the flaps are in the closed position.

As illustrated in FIG. 2, the hinges 11 extend only through a portion of the circumferential dimension of the outer edges 12.

Figure 3:
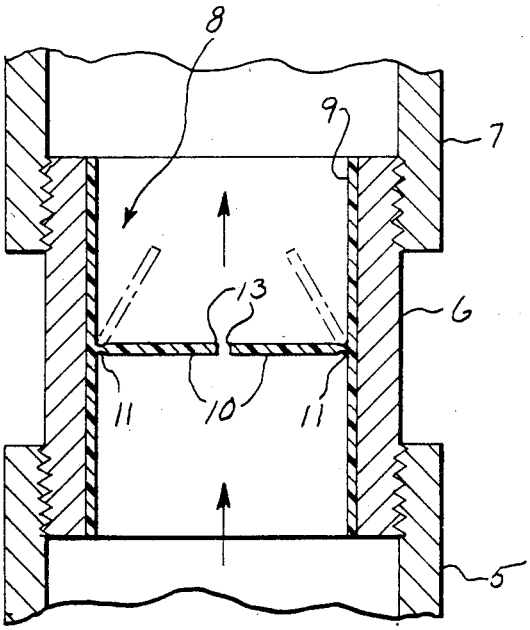
FIG. 3 is a view similar to FIG. 1 showing the damper in the open condition with water flow.

Under no-flow conditions, flaps 10 will extend transversely across the nipple 6 to thereby substantially prevent hot water heat loss through fitting 5 by convection. On demand for hot water, the water flow through outlet fitting 5 will pivot the flaps 10 upwardly, as shown by the dashed lines in FIG. 3, to thereby open the nipple and provide minimum restriction to flow. When the demand for heated water ceases and flow terminates, the flaps 10 will automatically return to their original transverse position to prevent convection flow through the nipple.

The thickness of the hinges 11, as well as their circumferential dimension and the material of the hinge, is designed so that the hinges will readily be moved to the full open position under normal flow rates encountered in a water heater and will have memory to return to their original closed condition after water flow has ceased.

The damper device of the invention is a one-piece molded plastic item which will minimize hot water heat loss during standby periods in the water heater. As the damping device is preferably a one-piece unit formed of plastic, it is inexpensive to produce and there is no operating noise involved in the movement of the flaps between the open and closed positions.

Various modes of carrying out the invention are contemplated as being within the scope of the following claims particularly pointing out and distinctly claiming the subject matter which is regarded as the invention.

I claim:

1. A tank assembly, comprising a tank to contain heated water, a fitting connected to said tank and disposed to conduct water, a generally cylindrical sleeve connected to the fitting, and a plurality of flaps integrally hinged to the sleeve, said flaps normally disposed transversely of said sleeve to close off flow of heated water by convection through said fitting during non-flow water conditions, water flow through said fitting acting to pivot said flaps to an open condition to provide minimum restriction to said water flow, each flap including an outer arcuate edge complementing the inner surface of said sleeve and each flap including a pair of side edges disposed in proximate relation to corresponding side edges of adjacent flaps when said flaps are in the closed position, each flap connected to the sleeve along a hinge portion, said hinge portion being smaller in circumferential dimension than said arcuate edge, said sleeve and said flap constituting an integral molded plastic unit.

2. The water heater of claim 1, and including a nipple connected to said fitting, said sleeve being disposed within said nipple and said flaps being located generally centrally of the length of said sleeve.

3. A tank assembly, comprising a tank to contain heated water, a fitting connected to said tank and disposed to conduct water, a water pipe, a nipple interconnecting said fitting and said water pipe, a sleeve disposed on the inner surface of said nipple, and a plurality of flaps integrally hinged to said sleeve and disposed generally centrally of the length of said sleeve, said flaps normally disposed transversely of said sleeve to prevent flow of heated water by convection through said nipple during non-flow conditions, water flow through said fitting acting to pivot said flaps to an open condition to provide minimum restriction to said water flow, said sleeve and said flaps being an integral molded plastic unit.

* * * * *